United States Patent [19]

Landa

[11] 4,350,333

[45] Sep. 21, 1982

[54] LARGE-CAPACITY SHEET-STACKING APPARATUS

[75] Inventor: Benzion Landa, Alberta, Canada

[73] Assignee: Savin Corporation, Valhalla, N.Y.

[21] Appl. No.: 167,462

[22] Filed: Jul. 11, 1980

[51] Int. Cl.[3] ..... B65H 31/10

[52] U.S. Cl. ..... 271/217

[58] Field of Search ..... 271/154, 155, 217, 218

[56] References Cited

U.S. PATENT DOCUMENTS

| | | | |
|---|---|---|---|
| 2,653,679 | 9/1953 | Hamilton | 271/155 UX |
| 3,722,879 | 3/1973 | Johnston | 271/217 UX |
| 3,905,595 | 9/1975 | Adams | 271/217 |
| 3,937,456 | 2/1976 | Groudis | 271/217 X |
| 3,969,993 | 7/1976 | Stobb | 271/218 X |
| 4,033,579 | 7/1977 | Stange | 271/217 X |
| 4,189,133 | 2/1980 | Arrasmith | 270/61 F |

OTHER PUBLICATIONS

IBM Technical Disclosure Bulletin, vol. 20, No. 5, pp. 1691, 1692, Oct. 1977, "Paper-Stack Height Control," Biship and Mares.

*Primary Examiner*—Richard A. Schacher
*Attorney, Agent, or Firm*—Shenier & O'Connor

[57] ABSTRACT

Apparatus for receiving and stacking a large number of sheets such as electrophotographic copies in which the height of a support to which sheets are successively delivered is adjusted in response to a photodetector arranged to sense the height of the stack of sheets on the support. The sheet support is raised and lowered by rotating a lead screw engaging a follower carried by the support and is limited in its excursion by stops on the follower which circumferentially intercept stops carried by the lead screw to prevent further rotation of the screw.

7 Claims, 6 Drawing Figures

3
18
10
50
42
30
46
34
20
21
62
40
28
24
23
22
146
144
48
148
54
56
37
12
52
75
26
3

10
32
30
S
20
18
21
16
P
28
24
23
36
34
22
144
148
146
26
14

LARGE-CAPACITY SHEET-STACKING APPARATUS

FIELD OF THE INVENTION

This invention relates to apparatus for receiving and stacking a large number of sheets and, especially, to apparatus for stacking copy sheets at the output of an electrophotographic copier.

BACKGROUND OF THE INVENTION

In recent years electrophotographic copiers that are capable of automatically producing multiple collated sets of copies of a multiple-page original have been developed. Such copiers typically operate by circulating originals from a stack past an exposure window, one sheet after another, for a number of passes equal to the number of sets of copies to be made.

One of the problems of copiers of this type, which are designed and used to produce a large number of copy sheets without human intervention, is the design of the copy exit tray. If one assumes a typical sheet thickness of 0.1 millimeter, then an exit tray capable of holding 800 sheets, for example, must be positioned at least 8 centimeters below the final set of exit rollers to allow the last sheet to clear the top of the stack. However, a drop of this distance results in unreliable stacking, owing to the size of the air pocket between the top of the stack and the sheet being fed. Rather than falling directly on the stack, the sheets tend to float down, thereby becoming misaligned. This misalignment is especially troublesome in copiers that stagger alternate sets of copy sheets to facilitate their ready separation.

SUMMARY OF THE INVENTION

One of the objects of my invention is to provide a sheet-stacking apparatus which is capable of accepting a large number of sheets.

Another object of my invention is to provide a sheet-stacking apparatus which is especially suited for stacking copies produced by an electrophotographic copier.

Still another object of my invention is to provide a sheet-stacking apparatus which maintains sheets in an aligned condition.

A further object of my invention is to provide a sheet-stacking apparatus which is simple and reliable.

Other and further objects will be apparent from the following description.

In general, my invention contemplates apparatus for stacking sheets such as copy sheets from an electrostatic copier in which sheets are fed one at a time to the top of a stack carried by a support. To ensure reliable delivery of the sheets to the support, the height of the support relative to the sheet feeding assembly is adjusted as sheets are fed thereto so as to maintain the top of the stack at a substantially constant level. Preferably, the support height is controlled by photoelectrically sensing the level of the top of the stack and rotating a lead screw engaging a follower carried by the support in response to the photoelectric sensor.

BRIEF DESCRIPTION OF THE DRAWINGS

In the accompanying drawings to which reference is made in the instant specification and in which like reference characters are used to indicate like parts in the various views.

DESCRIPTION OF THE PREFERRED EMBODIMENT

Figure 1:
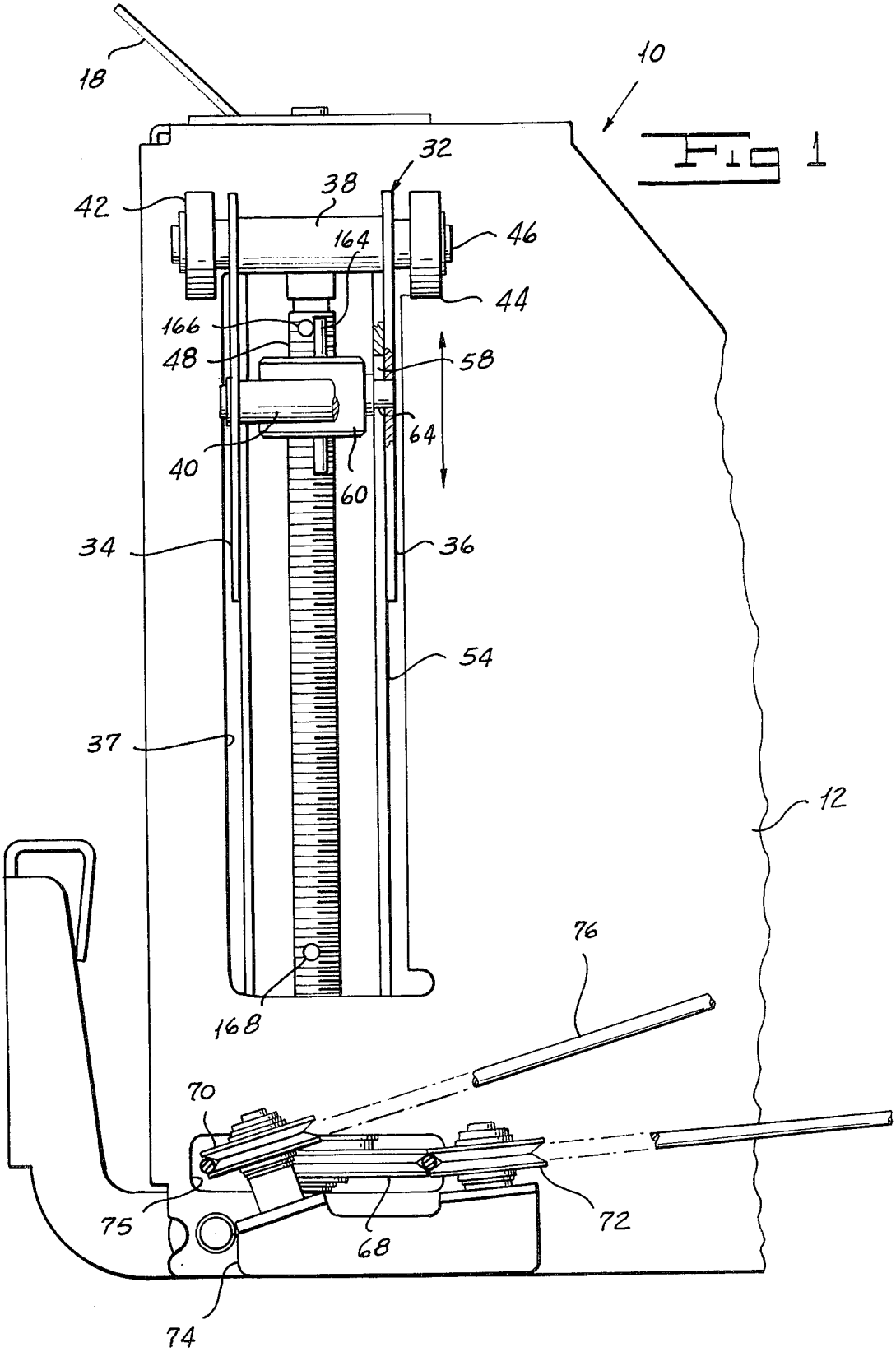
FIG. 1 is a fragmentary rear elevation, with parts shown in section, of a preferred embodiment of my sheet-stacking apparatus.
Figure 2:
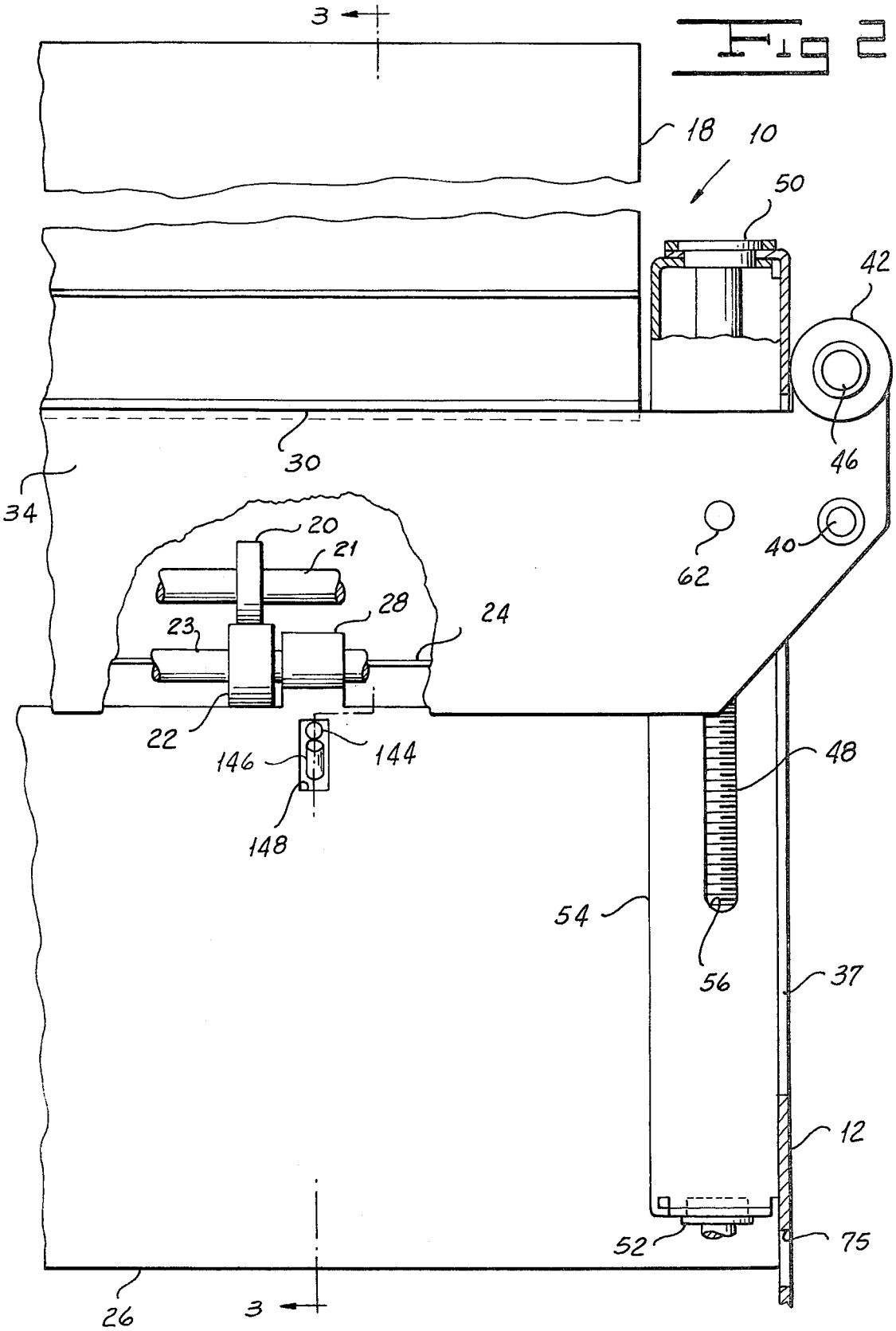
FIG. 2 is a fragmentary left-side elevation of my sheet stacking apparatus with parts broken away and with other parts in section.
Figure 3:
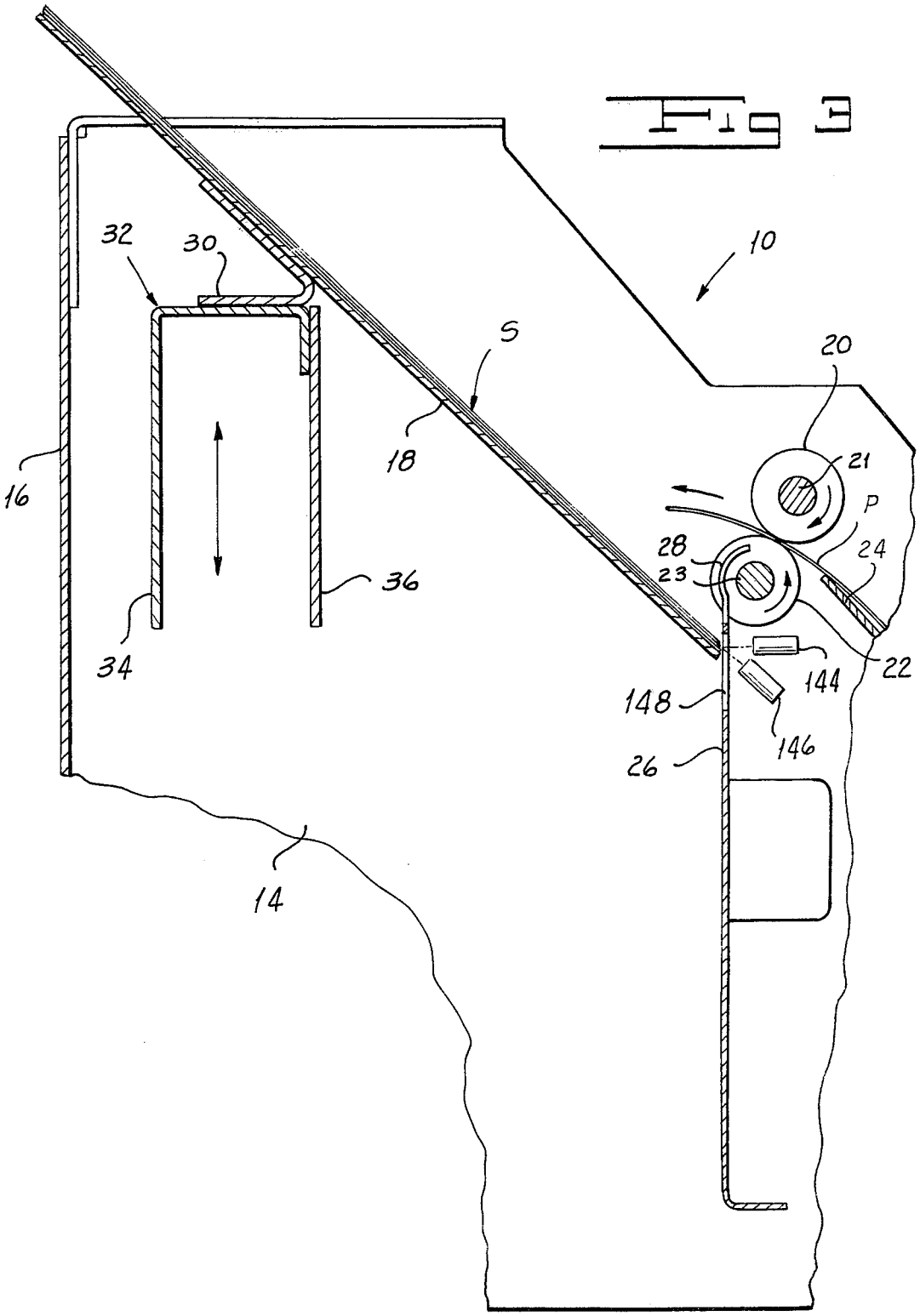
FIG. 3 is a fragmentary section of my sheet-stacking apparatus taken along line 3—3 of FIG. 2.

Referring now to the drawings, my sheet-stacking apparatus, indicated generally by the reference numeral 10, is housed by respective rear and front sidewalls 12 and 14 and by an end wall 16 extending between sidewalls 12 and 14. A plurality of upper feed rollers 20, one of which is shown, spaced along a shaft 21 extending between sidewalls 12 and 14 cooperate with a plurality of lower feed rollers 22, one of which is shown, spaced along a shaft 23 extending between walls 12 and 14. One of the shafts 21 and 23 is driven in a manner known to the art to cause the rollers 20 and 22 to deliver a sheet of paper P, supplied to rollers 20 and 22 along a guide 24, to a stack S carried by a support 18. Rollers 20 and 22 may be either transversely fixed or, as described in my copending application Ser. No. 120,474, filed Feb. 11, 1980, shifted transversely while delivering sheets of alternate sets of copies to stagger the alternate sets on the support 18. Support 18 is inclined upwardly in the direction of feed to bias sheets in the stack S against a backstop 26 disposed beneath rollers 22. Preferably backstop 26 is formed with one or more upwardly extending fingers 28 to prevent sheets from slipping between rollers 22 and the backstop 26.

I mount the support 18 by means of a V-shaped bracket 30 on a cantilevered carriage indicated generally by the reference numeral 32 formed from two transversely extending sheet metal members 34 and 36. Portions of sheet metal members 34 and 36 extend outwardly through a vertical slot 37 formed in sidewall 12 to receive an upper tubular spacer 38 and a lower spacer rod 40. A pair of wheels 42 and 44 carried by a shaft 46 extending through spacer 38 and through the outwardly extending portions of members 34 and 36 ride on the outer surface of sidewall 12.

I mount a vertically elongated housing 54 on the inner surface of wall 12 adjacent to the slot 37 with the housing extending through a space between sections 34 and 36 outboard of the edge of bracket 30 adjacent to wall 12. Upper and lower bearings 50 and 52 carried respectively in the top and the bottom of housing 54 rotatably support a lead screw 48 carrying a cylindrical nut 60. Pins 62 and 64 carried by nut 60 extend through respective vertical slots 56 and 58 in the sides of housing 54 and into openings in respective members 34 and 36 at locations below the axis of wheels 42 and 44. As will be apparent from the above description, rotation of the lead screw 48 raises and lowers the nut 60, thereby raising or lowering the carriage 32 and the sheet support 18. Wheels 42 and 44 ride on sidewall 12 to provide carriage 32 with a balancing moment about the fulcrum defined by pins 62 and 64, while housing 54 serves as a guide for members 34 and 36 to prevent the carriage 32 from rotating about a transverse axis.

Figure 4:
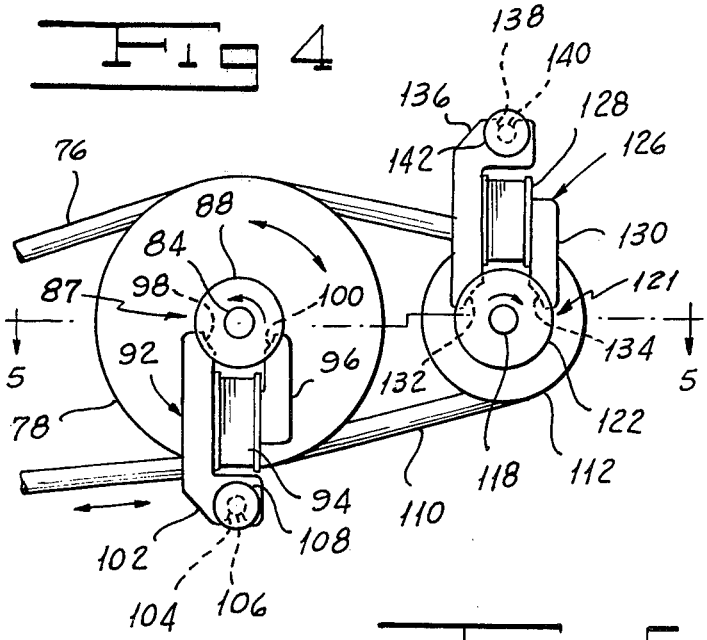
FIG. 4 is a fragmentary rear elevation of the clutch assembly of the apparatus shown in FIG. 1.
Figure 5:
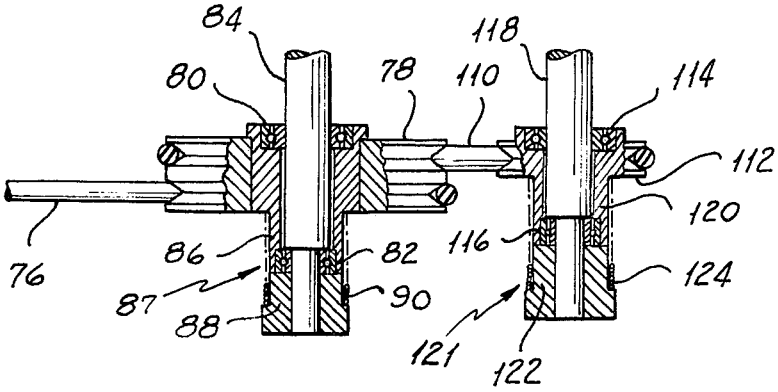
FIG. 5 is a fragmentary section of the clutch assembly shown in FIG. 4 taken along line 5—5 thereof.

Referring to FIGS. 1, 4 and 5, a pulley 68 carried on the lower end of lead screw 48 receives a drive belt 76. Belt 76 couples pulley 68 to a double-groove pulley 78 mounted for rotation about a transversely extending shaft 84 driven in a counterclockwise direction as viewed in FIG. 4 by any suitable means (not shown). Idler pulleys 70 and 72 carried by a bracket 74 mounted outboard of sidewall 12 direct the belt 76 through a slot 75 formed in sidewall 12 and around the inboard portion of pulley 68. Axially spaced bearings 80 and 82 support pulley 78 for rotation about shaft 84. Pulley 78 is formed with a reduced portion 86 which serves as the output hub of a spring clutch indicated generally by the reference numeral 87. A hub 88 carried at the outboard end of shaft 84 for rotation therewith serves as the input member of clutch 87. A helical coil spring 90 wrapping around portions of hubs 86 and 88 is fixedly attached at one end to input hub or driver member 88 for rotation therewith, but is slightly outwardly radially spaced from, and free to rotate relative to, the output hub or driver member 86.

I employ an electromagnet indicated generally by the reference numeral 92 to control the actuation of clutch 87. Electromagnet 92 comprises a coil 94 wrapped around a horseshoe-shaped armature 96 of magnetic material having spaced poles 98 and 100 shaped to ride upon the free end coils of spring 90 remote from input hub 88. I form an extension 102 of the magnetic core 96 with a slot 104 which receives a grooved portion 106 in a fixed pin 108. Pin 108 supports electromagnet 92 for movement of poles 98 and 100 a small distance away from the spring 90. Normally, when the magnet 92 is not energized, the free end coils of spring 90 slip relative to the output hub 86 and the clutch 87 remains disengaged. While it may be sufficient to form only one of the spring 90 and hub 86 of magnetic material, preferably I form both these members of magnetic material to ensure that in response to the energization of the magnet 92, poles 98 and 100 are drawn toward the adjacent portions of spring 90 and hub 86, retarding the rotation of the free end of spring 90 with the input hub 88. As a result, the free end portion of the spring 90 wraps down on the output hub 86, engaging the clutch 87 and coupling pulley 78 to shaft 84 to cause the pulley 78 to rotate counterclockwise.

I also couple pulley 78 by means of an additional belt 110 to a pulley 112 supported by axially spaced bearings 114 and 116 for rotation about a shaft 118 driven in a clockwise direction as viewed in FIG. 4 by any suitable means (not shown). Pulley 112 is formed with a hub 120 which serves as the output hub of an additional spring clutch indicated generally by the reference numeral 121. A hub 122 carried at the outboard end of shaft 118 serves as the driver member of clutch 121. Like clutch 87, clutch 121 has a spring 124 surrounding portions of the input and output hubs 122 and 120. Spring 124 is fixedly coupled at one end to input hub 122 but is radially outwardly spaced at the other end from output hub or driven member 120 so as to rotate freely relative thereto. An electromagnet indicated generally by the reference numeral 126 controls the actuation of clutch 121. Like electromagnet 92, electromagnet 126 comprises a horseshoe-shaped armature 130 supporting a coil 128 and having a pair of spaced pole pieces 132 and 134 shaped to ride on the free end portion of spring 124 overlying output hub 120. An extension 136 of core 130 is formed with a slot 138 which receives a grooved portion 140 of a fixed pin 142. Pin 142 supports electromagnet 126 for movement a small distance away from the clutch 121.

The operation of clutch 121 is similar to that of clutch 87. Normally, with the electromagnet 126 not energized, the free end portion of spring 124 slips relative to output hub 120 and clutch 121 remains disengaged. In response to energization of the electromagnet 126, the pole pieces 132 and 134 move toward the adjacent portions of spring 124 and hub 120 to retard the rotation of the free end of the spring 124 and cause it to wrap down on output hub 120 to engage the clutch 121. In response to actuation of clutch 121, pulley 112, and hence pulley 78, are driven clockwise along with shaft 118.

I provide lead screw 48 with a right-hand thread so that, in response to counterclockwise rotation of pulley 78 upon energization of clutch 87, screw 48 is driven so as to raise support 18. On the other hand, in response to clockwise rotation of pulley 78 upon energization of clutch 121, screw 48 is driven in such a direction as to lower the support 18. To control the raising and lowering of support 18 in response to the level of the top sheet of the stack S, I dispose a suitable light source 144 in such a manner as to direct a beam of light through a slot 148 formed in backstop 26 onto a spot portion (not shown) of the trailing edge of the accumulated stack S. A photodiode 146 disposed on the same side of backstop 26 as the light source 144 senses reflected light from the spot portion. Photodiode 146 is oriented in such a manner, such as parallel to the plane of sheet support 18, that it only intercepts light reflected from the trailing edge of the stack S, and does not intercept light reflected from the top surface of the stack.

The amount of reflected light intercepted by photodiode 146 depends on the level of the top sheet of the stack S. If the trailing edge of the top sheet is below the trailing-edge spot portion normally illuminated by light source 144, the photodiode 146 will intercept no reflected light. If, on the other hand, the trailing edge of the top sheet is above the spot portion illuminated by light source 144, photodiode 146 will intercept a relatively constant amount of light which does not increase as further sheets are added to the stack S. In intermediate situations, where the trailing edge of the top sheet is somewhere within the spot portion normally illuminated by light source 144, photodetector 146 will intercept an amount of light which increases as the trailing edge of the top sheet is raised.

While it is possible to use other devices for sensing the height of the stack S, I have found it especially advantageous to employ a photodetector of the type described above which is sensitive to reflected light from the trailing edge of the stack. Such a photodetector operates effectively with translucent sheets P as well as with sheets that are arranged in transversely staggered copy sets to facilitate their ready separation. It will readily be appreciated that as an alternative, one might use a mechanical feeler and switch in place of the photodetector.

Figure 6:
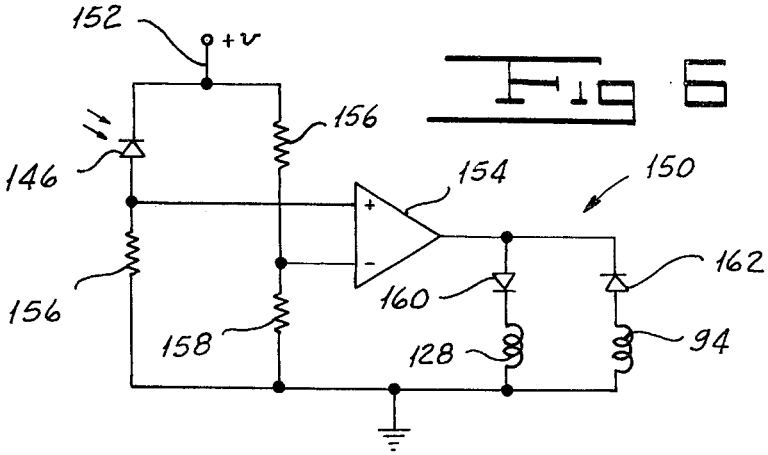
FIG. 6 is a schematic diagram of one form of circuit for controlling the operation of my sheet-stacking apparatus.

Photodiode 146 provides the input to a control circuit indicated generally by the reference numeral 150. Referring now to FIG. 6, in the circuit 150, photodiode 146 has its cathode coupled to a line 152 providing a positive DC potential and has its anode coupled to the noninverting input of a differential amplifier 154. A resistor 156 couples the noninverting amplifier input to ground. The inverting input of amplifier 154 is coupled to line 152 and to ground through resistors 156 and 158 respectively. Resistors 156 and 158 are selected to provide a potential to the inverting amplifier input equal to the potential at the noninverting input for a predetermined position of the top sheet trailing edge within the area normally illuminated by light source 144. Amplifier 154 drives magnetic coil 128 through a diode 160 and magnetic coil 94 through a diode 162. Diodes 160 and 162 are so oriented that a sufficiently positive output from amplifier 154 drives coil 128, while a sufficiently negative amplifier output drives coil 94.

The operation of the control circuit 150 is as follows. Assume first that the top sheet in the stack S is below light source 144 so that photodiode 146 intercepts no reflected light from the trailing edge of the stack S. This condition may occur either initially when the apparatus 10 is about to receive sheets P or at a later point after sheets have been removed by the operator from the stack S. In this case, photodiode 146 remains substantially nonconductive, causing the noninverting input of amplifier 154 to assume a relatively low potential. Since the inverting input of amplifier 154 is at an intermediate potential, the amplifier 154 provides a negative output energizing coil 94 through diode 162. As a result, electromagnet 92 actuates clutch 87 to rotate pulley 78 counterclockwise. In response to counterclockwise rotation of pulley 78, lead screw 48 raises support 18. When the support 18 has risen to such a level that the anode potential of photodiode 146 equals the potential of the inverting input of amplifier 154, the output of amplifier 154 returns to zero, disabling clutch 87. Preferably, the reflectance of the trailing edge of the support 18 approximates that of the sheets P to ensure that the screw 48 is eventually disabled if there are no sheets on the support.

When, following the delivery of additional sheets P to the stack S, the anode potential of photodiode 146 becomes slightly more positive, amplifier 154 provides a positive output, driving coil 128 through diode 160. In response to energization of coil 128, clutch 121 couples pulley 112 to shaft 118 to rotate pulley 78 clockwise. Clockwise rotation of pulley 78 in turn drives lead screw 48 in such a direction as to lower the sheet support 18 and thereby eventually remove the energizing signal from the output of amplifier 154.

Circuit 150 repeatedly actuates clutches 87 and 121 in response to photodiode 146 in the manner described above to maintain the top of the stack S at the desired level. Because of the slight voltage drop across diodes 160 and 162 even when in a conducting state, there will be an intermediate range of positions of the top sheet trailing edge within the illuminated spot area where the lead screw 48 will remain unenergized. This small "backlash" region avoids the undesirable result of having the support 18 continually either being raised or being lowered.

To limit the vertical excursion of the tray 18, I provide the lead screw 48 with radially extending pins 166 and 168 near the top and bottom, respectively, of the lead screw. I further provide nut 60 with a pin 164 which extends axially both above and below the nut. Pin 164 is so disposed relative to pins 166 and 168 that it circumferentially intercepts pin 166 when lead screw 48 is driven to raise nut 60 a predetermined extent and circumferentially intercepts pin 168 when the lead screw is driven to move the nut downwardly a predetermined extent. Since the pin 164 abuts elements rotating with lead screw 48, it effectively prevents further rotation of the lead screw by inducing slippage in the drive train comprising belts 76 and 110. By contrast, if one attempted to limit the excursion of support 18 by intercepting a vertically traveling element, jamming might result from the mechanical advantage developed by the screw 48.

It will be seen that I have accomplished the objects of my invention. My sheet-stacking apparatus is capable of accepting a large number of sheets and is especially suited for stacking copies produced by an electrophotographic copier. My apparatus maintains sheets in their original aligned condition and is simple and reliable.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention what I claim is:

1. Sheet-stacking apparatus including in combination means adapted to support a stack of sheets, means for feeding sheets to said supporting means to form a stack thereon, means for sensing the level of the top of the stack, a lead screw, a follower engaging said lead screw, means coupling said follower to said supporting means, means responsive to said sensing means for driving said lead screw to control the level of said supporting means, a first stop extending radially from said lead screw, and a second stop extending axially from said follower, said second stop being so disposed as to intercept said first stop at a predetermined position of said follower to prevent the further rotation of said lead screw.

2. Apparatus including in combination means adapted to support a stack of sheets, a lead screw, a follower engaging said lead screw, means coupling said follower to said supporting means, means for driving said lead screw to control the level of said supporting means, a first stop carried by said lead screw, and a second stop carried by said follower, said second stop being so disposed as to intercept a leading portion of said first stop with respect to the circumferential movement thereof at a predetermined position of said follower to prevent the further rotation of said lead screw.

3. Apparatus including in combination means adapted to support a stack of sheets, a lead screw, a follower engaging said lead screw, means coupling said follower to said supporting means, means including a slipping element for driving said lead screw to control the level of said supporting means, a first stop carried by said lead screw, and a second stop carried by said follower, said second stop being so disposed as to intercept a leading portion of said first stop with respect to the circumferential movement thereof at a predetermined position of said follower to prevent the further rotation of said lead screw.

4. Apparatus including in combination means adapted to support a stack of sheets, a lead screw, a follower engaging said lead screw, means coupling said follower to said supporting means, means for driving said lead screw to control the level of said supporting means, a first stop extending radially from said lead screw, and a second stop extending axially from said follower, said second stop being so disposed as to intercept said first stop at a predetermined position of said follower to prevent the further rotation of said lead screw.

5. Apparatus including in combination means adapted to support a stack of sheets, means for feeding sheets to said supporting means to form a stack thereon, a lead screw, a follower engaging said lead screw, means coupling said follower to said supporting means, means for driving said lead screw to control the level of said supporting means, a first stop carried by said lead screw, and a second stop carried by said follower, said second stop being so disposed as to intercept a leading portion of said first stop with respect to the circumferential movement thereof at a predetermined position of said follower to prevent the further rotation of said lead screw.

6. Sheet-stacking apparatus including in combination means adapted to support a stack of sheets, means for feeding sheets in a certain direction to said supporting means to form a stack thereon, said feeding means being selectively operable to deliver sheets to said supporting means at laterally offset locations with respect to said direction of feed, means for retaining the trailing edge of said stack with reference to said direction of feed, said supporting means being inclined in such a manner as to bias said stack against said retaining means, means for sensing the level of the top of said trailing edge of said stack, and means responsive to said sensing means for controlling the level of said supporting means.

7. Sheet-stacking apparatus including in combination means adapted to support a stack of sheets, means for feeding sheets in a certain direction to said supporting means to form a stack thereon, said feeding means being selectively operable to deliver sheets to said supporting means at laterally offset locations with respect to said direction of feed, means for retaining the trailing edge of said stack with reference to said direction of feed, said supporting means being inclined in such a manner as to bias said stack against said retaining means, means for sensing the level of the top of a portion of said stack adjacent said retaining means, and means responsive to said sensing means for controlling the level of said supporting means.

* * * * *